US011127384B1

(12) United States Patent
Fugate

(10) Patent No.: US 11,127,384 B1
(45) **Date of Patent: *Sep. 21, 2021**

(54) SYSTEM FOR SUPPORT AND RESONATION OF A MUSICAL INSTRUMENT

(71) Applicant: Brett Fugate, Washington, IL (US)

(72) Inventor: Brett Fugate, Washington, IL (US)

( * ) Notice: Subject to any disclaimer, the term of this patent is extended or adjusted under 35 U.S.C. 154(b) by 602 days.

This patent is subject to a terminal disclaimer.

(21) Appl. No.: 16/134,151

(22) Filed: Sep. 18, 2018

Related U.S. Application Data

(62) Division of application No. 15/687,189, filed on Aug. 25, 2017, now Pat. No. 10,109,263.

(60) Provisional application No. 62/380,125, filed on Aug. 26, 2016.

(51) Int. Cl.
*G10G 5/00* (2006.01)
*G10D 13/08* (2020.01)
*G10D 13/10* (2020.01)

(52) U.S. Cl.
CPC ..... *G10G 5/005* (2013.01); *G10D 13/08* (2013.01)

(58) Field of Classification Search
USPC ..... 84/402
See application file for complete search history.

(56) References Cited

U.S. PATENT DOCUMENTS

| | | | | |
|---|---|---|---|---|
| 4,625,617 | A | 12/1986 | Hara et al. | |
| 4,684,091 | A * | 8/1987 | Moreschi | F16M 11/046 211/182 |
| 4,881,442 | A | 11/1989 | Stevens | |
| 5,479,843 | A | 1/1996 | Yanagisawa | |
| 6,096,955 | A | 8/2000 | Heide | |
| 10,109,263 | B1 * | 10/2018 | Fugate | G10G 5/005 |
| 2007/0012160 | A1 | 1/2007 | Sato | |
| 2013/0042745 | A1 | 2/2013 | Shimada | |

OTHER PUBLICATIONS https://www.amazon.com/Sound-Percussion-Labs-Rolling-OCTAVE/dp/B00JS9OFDM. Bell Kit with Rolling Cart.
http://www.lonestarpercussion.com/Stands-Hardware/Glockenspiel-Stands/Yamaha-Student-Percussion-X-Style-Bell-and-Pad-Stand-SPXS-20.html.

* cited by examiner

*Primary Examiner* — Christopher Uhlir
(74) *Attorney, Agent, or Firm* — Lesley A. Wallerstein, LLC

(57) ABSTRACT

This is a universal support system for bar percussion instruments. It can support any size and type bar percussion instrument, in any size snare basket, with any snare basket arm bracket variations. When used in a snare basket having a ball joint, the system can tilt the bar percussion instrument into infinitely many positions, enabling performance art never before possible with this type of instrument.

11 Claims, 8 Drawing Sheets

SYSTEM FOR SUPPORT AND RESONATION OF A MUSICAL INSTRUMENT

CROSS-REFERENCE TO RELATED APPLICATION

This is a continuation-in-part application of application Ser. No. 15/687,189, filed 25 Aug. 2017, which in turn claims priority to Provisional Application 62/380,125, filed 26 Aug. 2016.

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to an improved system for support and resonation of musical instruments, particularly bar percussion instruments.

BACKGROUND OF THE INVENTION

Most bar percussion instruments such as xylophones, marimbas, vibraphones, glockenspiels and bell kits have a trapezoidal footprint. They are played standing up, so they must rest on something that supports the instrument at a comfortable playing height. Musicians and manufacturers of these instruments continue to struggle with ways to mount them. It has to optimize portability and playability, while still preserving sound quality.

Bar percussion instruments generally comprise a row or rows of tone-generating elements ("bars") laid side by side atop and across a bed of four longitudinal rails. Each rail is approximately 36 inches long, by 0.75 inch thick. The first rail and the second rail are 1.5 inches tall. The third rail and the fourth rail are 2.81 inches tall. The longitudinal rails, plus short end pieces joining them, form a trapezoid shape. The frame can be defined as the part of the instrument that holds the keyboard in place. Frames are typically made from wood, metal, composite, fiberglass and combinations thereof. Other dimensions of bars, rails, end pieces and frames are possible, as long as there are four rails, two end pieces holding them in place and the instrument in its frame has a trapezoid shape.

These instruments, as laid flat with the rails facing up, have a side facing the player ("player side") and a side facing the audience ("audience side"). In a typical concert hall setup, the rail closest to the player is called the first rail. The second closest to the player is the second rail, followed by the third rail. The rail closest to the audience is the fourth rail. The player side row of bars corresponds to white keys of a piano. The audience side row of bars corresponds to the black keys of a piano. The differences relate to the materials used for the bars, and the range of notes played. Xylophones are typically made of wood or synthetic material and have a range up to 4 octaves. They may have resonator tubes suspended beneath the rails and the frame. Marimbas have two rows of wooden bars, beneath which also are resonator tubes. Vibraphones are more similar to marimbas than to xylophones, but are made of metal, thus generate and sustain sound for comparatively more time.

The frames, whatever material they may be, are usually mounted onto some sort of cart, pedestal, X-stand or other apparatus to hold the keyboard and frame at suitable height for the player. Traditionally carts have wheels, cross bars, braces or trusses, resonator mounts, hinges, pedals (in the case of vibraphones), and other types of mechanisms to provide support, stability, aural qualities, and consistency to the keyboard. Whether or not any of these features are included on a particular instrument model is largely dependent upon the size and application of a particular model. Some models of bar percussion instruments have thermometers built into the frames or carts. Some frames cannot be removed (or cannot be easily removed) from the carts, while others can be completely broken down as part of the design and function, allowing for smaller pieces for ease of storage and/or portability.

Over time, manufacturers have responded to retail customer feedback and increased competition from online stores to create instruments that are low cost, portable, and high quality. It is now possible to buy bar percussion instruments a la carte, without many of the essential and traditional accessories. For example, full size marimbas can be purchased without carts or resonator tubes. These instruments are usually referred to as practice instruments and can be mounted or set on a generic X-stand. An X-stand is essentially a stand that a person may use for an electronic keyboard. Without a cart, X-stand or resonator tubes, the instrument can also be set on a tabletop, floor, or any other suitable flat surface. Without these features the cost of the instrument is significantly reduced and this makes the instruments more accessible by a wider group of empowered consumers and that has put the manufacturers of the instrument in a sort of "arms race" to achieve the lowest cost with the greatest quality and portability.

In the educational market, bell kits have been utilized as a standard percussion instrument. Bell kits do not have wooden keyboards. Rather, they have tone bars that are made from thin aluminum or steel. This makes them relatively cheap, lightweight, and easy to transport, although they ultimately lack the look, feel, and sound of a real xylophone or marimba.

The music education industry as a whole recognizes that the bell kits, while low in price, have some critical limitations. They do not fully replicate the experience of playing a professional xylophone, marimba or vibraphone, making the transition to those instruments difficult. One popular solution is a portable xylophone. They are similar in size to the bell kits, which make it easier for an adolescent or other smaller user to play and to carry. More importantly, they more accurately duplicate the aesthetic, empathic, and aural properties, attributes, and qualities that the end user will encounter with concert level bar percussion instruments.

Bell kits and portable xylophones can be played serviceably when laid onto rolling carts or tables. The carts and tables are stable, but not very portable, and not adaptable to marimbas, which can have resonator tubes hanging below the plane of the rails. Moreover, the carts and rails themselves vibrate somewhat when the instrument is played, muddying the sound. This is not acceptable at the professional level. What is most needed in this field is a way to support all bar percussion instruments in a way that is portable, flexible, secure, and allows it to resonate as intended.

A snare drum basket is conventionally used to enclose and support drums. A snare drum basket typically comprises three arms which radiate outward from a central hub. The basket itself connects to and sits atop a central post, which in turn sits atop a tripod. The basket can be fixed in place, or else be connected to the post by a movable joint. Each arm has a proximal end which attaches to the central hub, and a distal end having a bracket. The three distal ends define the points of a supporting triangle. Preferably, the supporting triangle is equilateral, but it can be isosceles or scalene. The brackets have different shapes, most notably a pointed "L" shape and a more rounded "J" shape. These brackets can be mechanically adjusted to hold drums of differing diameters (or other types of dimensions). The three arms are joined to the central hub by hinge, allowing them to move vertically in place. The arms can open flat relative to the central hub to create a relatively large triangular opening, or fold toward the central hub to create a relatively small triangular opening. The arms can be secured into these positions, or any position, in between.

Interestingly, the triangular basket portion of a snare drum kit can in theory also be used to support trapezoidal bar percussion instruments. Bar percussion instruments can be oriented in such a way so that they rest solely on and between the three brackets. This leaves plenty of space below the basket for resonator tubes to hang. Because of this space, the instrument is free to resonate without interference from a solid table or cart.

Some manufacturers place blocks or threaded inserts between the number 2 and 3 rails. These blocks allow the bar percussion instrument to rest in certain proprietary stands, and only these proprietary stands. Percussion instruments with these blocks and inserts do not fit conventional snare drum baskets. Moreover, these blocks are screwed to both rails, pulling the rails toward each other. This warps the rails and creates a choking point on both the natural and sharp scales.

Even supported by its stand, the bar percussion instrument with blocks still slips out of position while played. Moreover, the "L" bracket on the basket can scratch one or more of the rails. It can also ride up and touch the tone bars, attenuating the sound. Players may try to compensate for this slippage by tightening the basket upon the instrument. This can ultimately cause key points of rails to crack and the dado joints holding them together to disintegrate. It damages the finish of the instrument.

One solution has been to twist the brackets and change their orientation. While this modification may hold certain bar percussion instruments, it does not adapt to all bar percussion instruments and no longer holds snare drums. Yet another solution manufactures have pursued is to shorten the distance of the "L" brackets. This is supposedly to eliminate the bar percussion instruments from slipping. The frame of the instrument rests directly on the "L" bracket and eliminates the chance that the instrument will slip. In this way, the "L" bracket will not collide with the tone bars. This solution does allow the stand to grip a smaller, thinner, and lighter weight practice pad, but ironically may not accommodate a snare drum. The snare drum basket is readily available, lightweight, portable and allows a bar instrument to properly resonate. What it lacks is stability, security and universality.

To improve upon and address these problems, I have created a universal support system for bar percussion instruments. It can support any size bar percussion instrument in any snare stand, with any bracket variation. My system eliminates slippage. It eliminates the need to apply excess force on the instrument rails, reducing mechanical damage and prolonging the life of the instrument. When used with a snare drum stand having a ball joint, the musician can tilt the instrument at any angle. This would not have been possible with previous snare basket adaptations. Bar percussionists now have the option of angling the instrument in a new orientation as performance art, opening up a universe of new interpretations and creative ways to perform particular musical passages.

I do this by creating a receiving triangle within the trapezoidal rails of any bar percussion instrument, corresponding to and securely coupling it to the snare basket triangle. Two points of the receiving triangle are defined by a corner brace and by a bolt installed perpendicularly through the third rail such that a first portion of the bolt extends into a space between the third rail and the fourth rail, and a second portion of the bolt extends into a space between the second rail and the third rail. The third point of the receiving triangle is simply a point along the bottom of the fourth rail, 45.5% of the distance from a left side of the audience-facing side of the fourth rail ("the 45.5% point").

The corner brace comprises a flat surface and a pair of flaps extending from and perpendicular to the flat surface and meeting in a corner joint. The flat surface of the corner brace is affixed corner joint up to a player-facing surface of the first rail, approximately halfway along its length. Preferably, a standard 2-inch corner brace is used, but alternative size corner braces with corner joints may be selected, in the best judgment of one of ordinary skill in the art. The exact distances of the corner brace from either end of the rail may vary depending on the length of the rail itself. However, the proportion should be the same to preserve the shape of the receiving triangle.

The bolt is installed perpendicularly through the third rail so that it extends into the space between the third and the fourth rails, as well as into the space between the second rail and the third rail. The distance the bolt extends into either space can be varied and adjusted depending on the particular snare drum basket. By installing the bolt through the third rail, this system can support all bar percussion instruments. The desired position is secured by a nut. Preferably, a ⅜ 16 size bolt is chosen, but other sizes of bolt may be substituted by one of ordinary skill in the art, without deviating from the spirit or intent of this disclosure. A custom mechanical and CNC template ensure the corner brace, the bolt and the 45.5% point of the bottom of the fourth rail form a consistently proportioned receiving triangle on any size bar percussion instrument, and one that is congruent with the supporting triangle defined by the snare drum basket brackets.

REFERENCE NUMERALS

Figure 1:
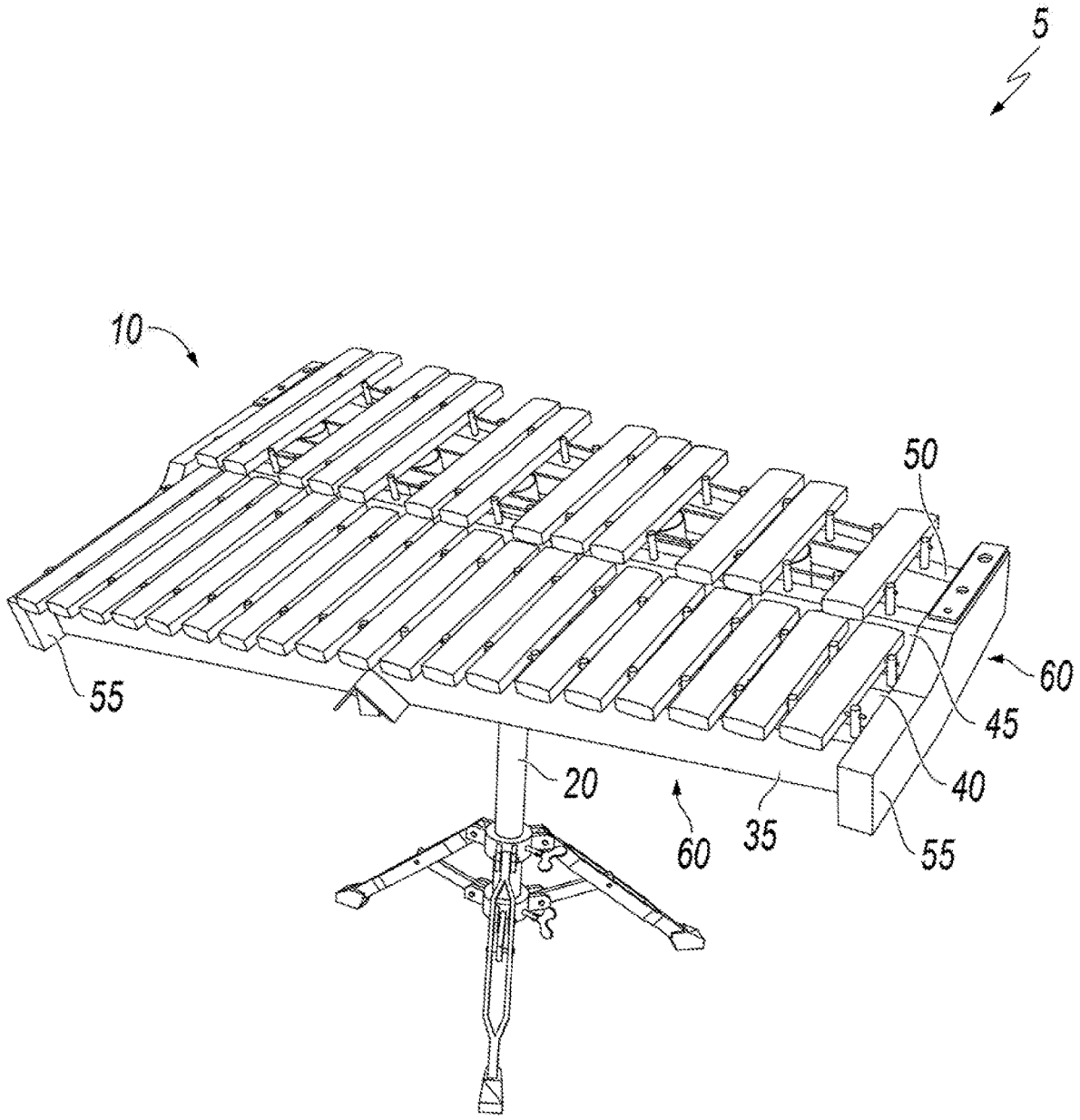
FIG. 1 is a perspective view of an improved system for the support and resonation of a musical instrument.

5. System for supporting bar percussion instruments
10. Bar percussion instrument
15. Snare drum basket
20. Central post
23. Central hub
25. Arm
30. Bracket
35. First rail
40. Second rail
45. Third rail
50. Fourth rail
53. Resonator tubes
55. End piece
60. Frame
65. Supporting triangle
70. Corner brace
75. Bolt
80. Receiving triangle
85. Ball joint
90. Musician

DETAILED DESCRIPTION OF THE INVENTION

FIG. 1 shows an overall view of an improved system for support and resonation of a musical instrument 5. Please note a bar percussion instrument 10, comprising a two rows of tone bars set upon a frame 60. The frame comprises a first rail 35, a second rail 40, a third rail 45 and a fourth rail 50. Each of the four rails is a longitudinal rectangle. The four rails are arranged side by side to form a trapezoidal footprint. The rails are held in position by opposing end pieces 55. Affixed to a player-facing side of the first rail is a corner brace 70. The frame of the bar percussion instrument is supported from beneath by a snare drum basket (not shown in this view). The snare drum basket is connected to central post 20 of a complete snare drum stand.

Figure 2:
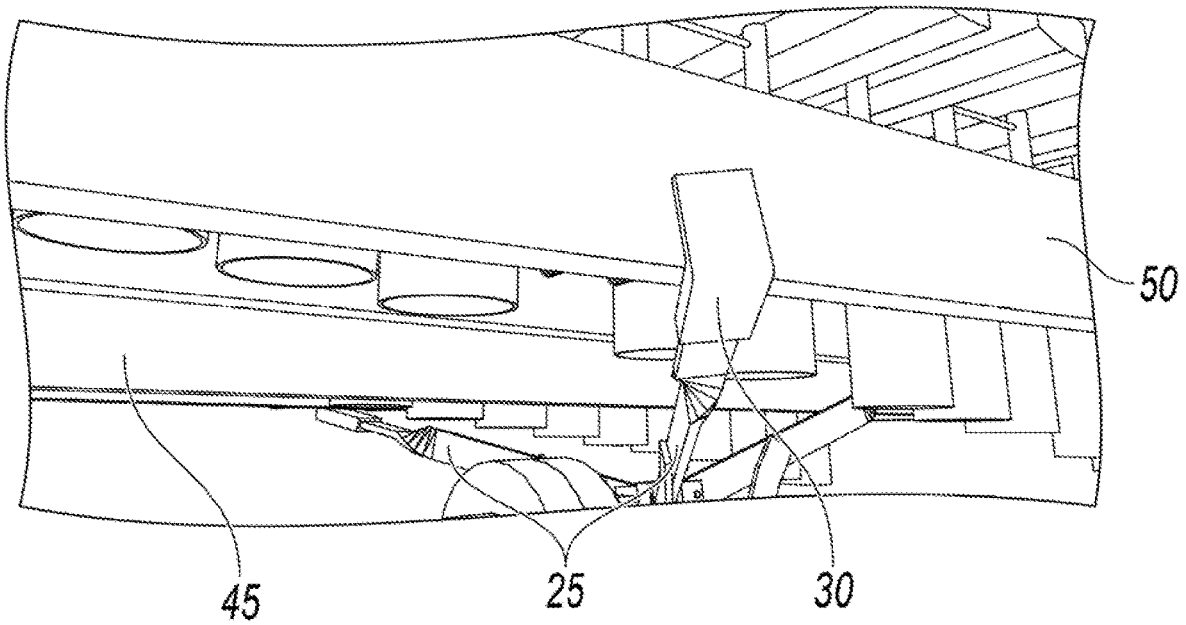
FIG. 2 is a close-up, perspective view of the audience side of the system.
Figure 3:
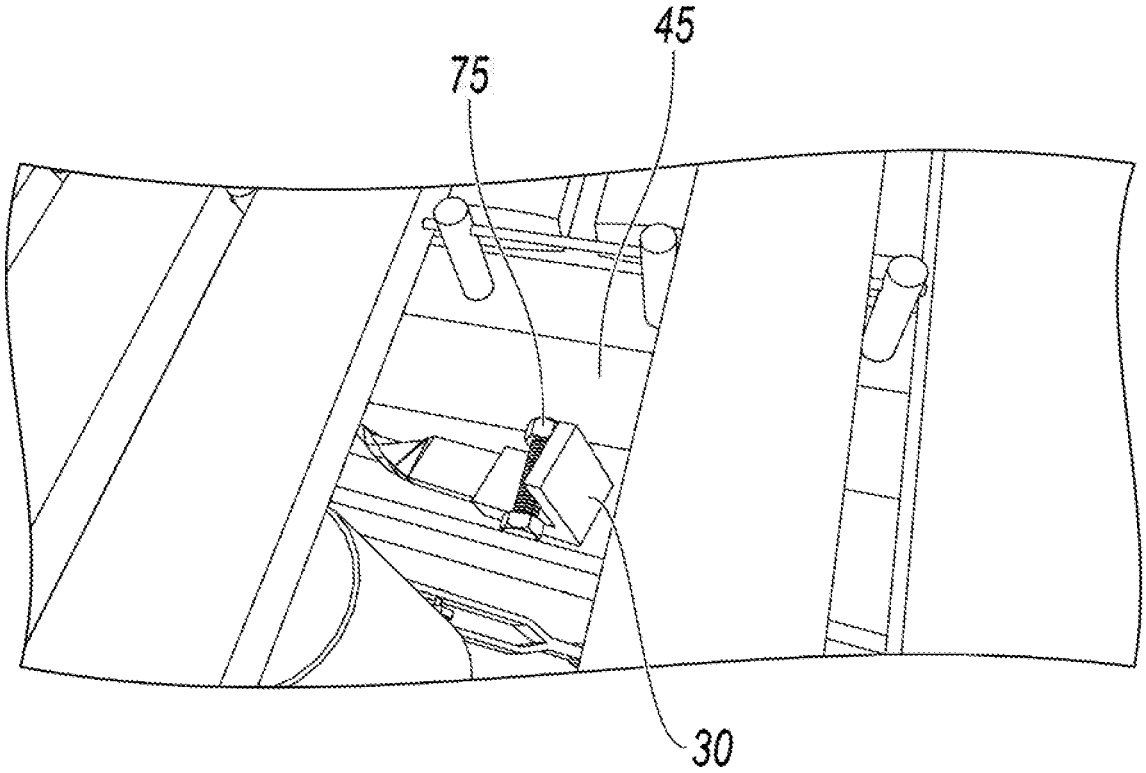
FIG. 3 is a close-up, top view of the system.

FIG. 2 illustrates in detail a bracket 30 of the snare drum basket supporting the 45.5% point of the bottom side of the fourth rail 50. From this view, one can also see three arms 25 of the snare basket. The arm in the front supports from beneath the 45.5% point of fourth rail 50. In the distance, a second arm supports the player-facing side of the first rail. Partially hidden from view, one can also see the third arm between the third rail 45 and the fourth rail 50. FIG. 3 shows in detail how bolt 75 rests upon and is supported by the third rail 45.

Figure 4:
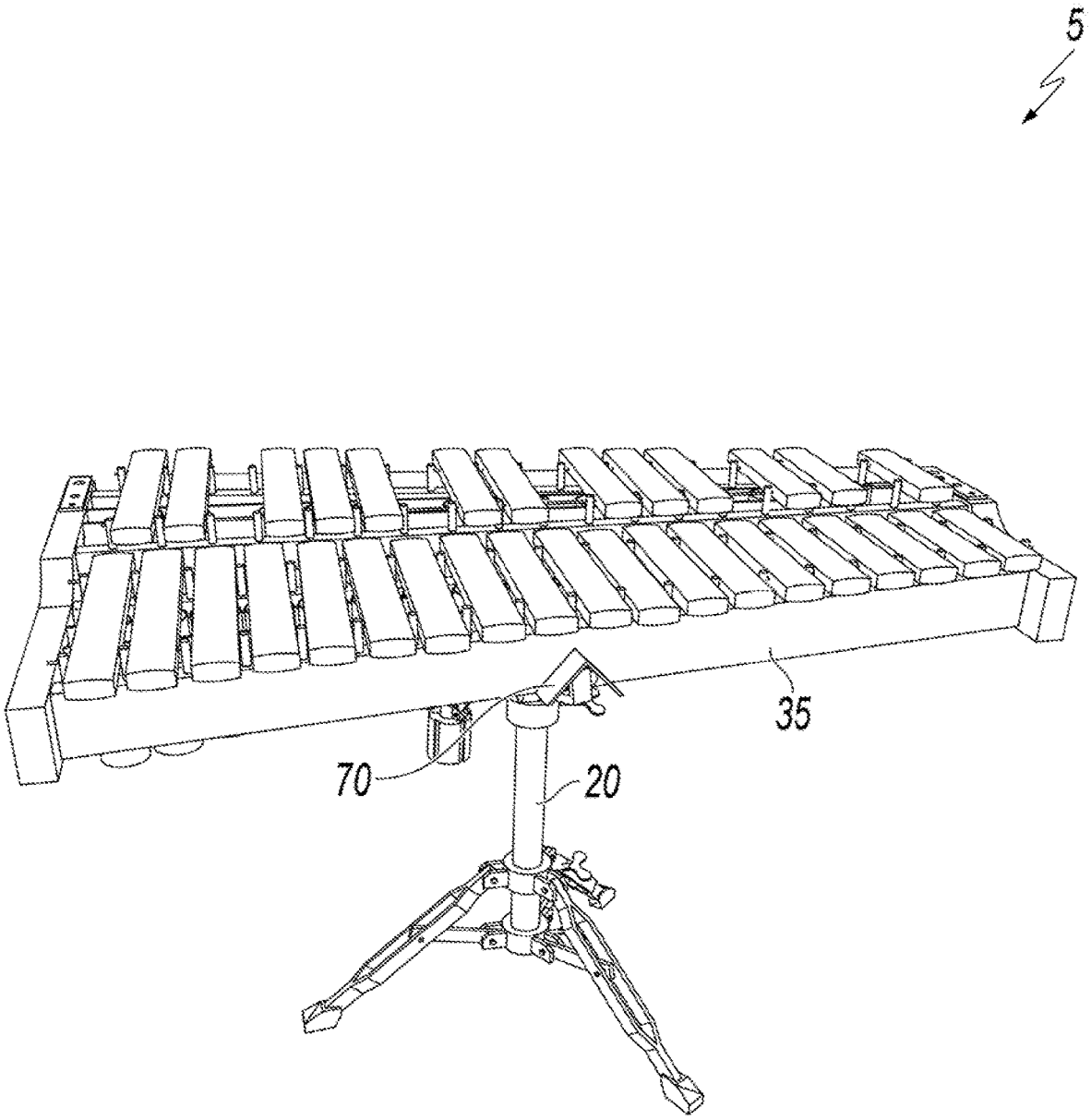
FIG. 4 is a perspective view of the player side of the system.
Figure 5:
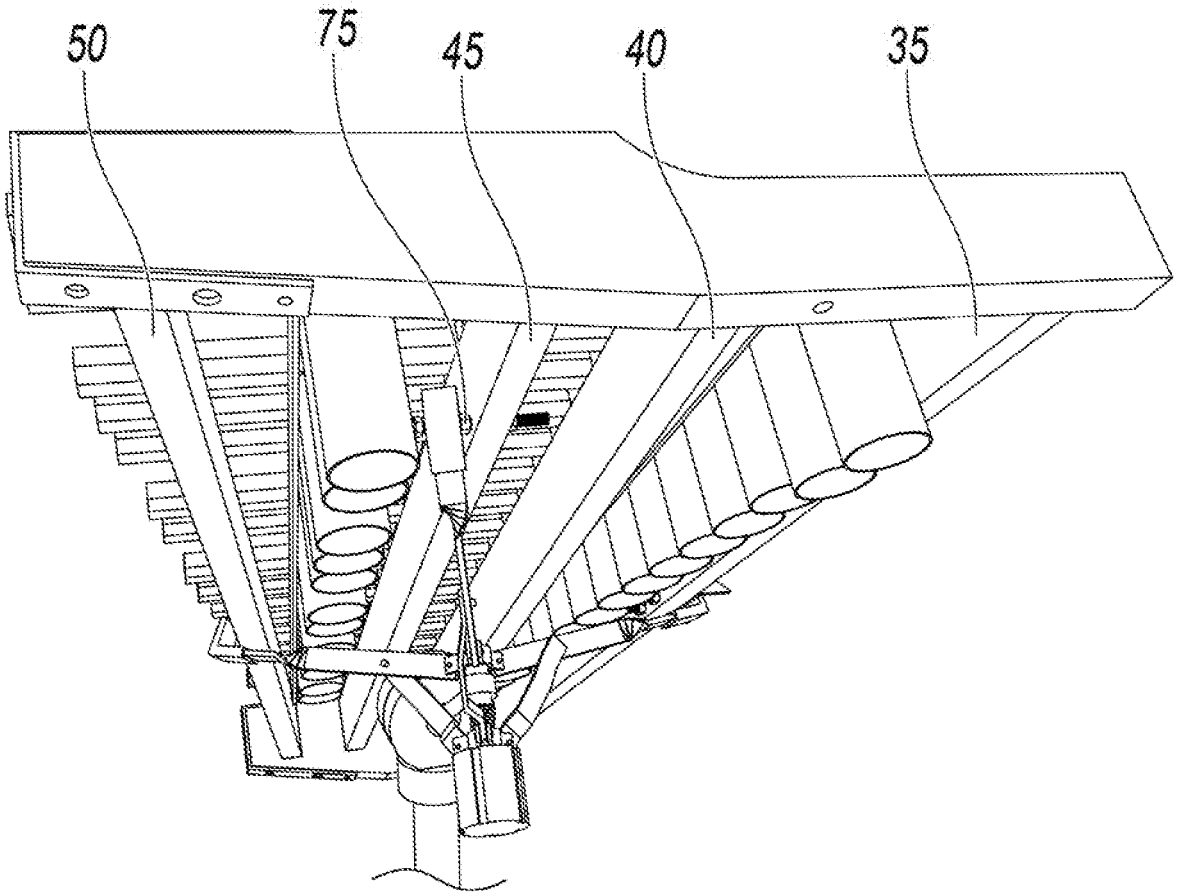
FIG. 5 is a perspective side view of the system.

FIG. 4 shows the system viewed from the perspective of a musician. Facing the player is the first rail 35. FIG. 5 shows the system viewed from slightly beneath the level of the frame. One can see here the central hub 23 of the snare basket, and how each arm connects to the central hub. This particular bar percussion instrument has a row of resonator tubes 53 hanging between two adjacent rails. Note how the resonator tubes do not touch the snare drum basket. This allows them to freely and accurately resonate. Please note bolt 75 passing entirely through the third rail 45. Part of the bolt 75 occupies the space between the third rail 45 and the fourth rail 50. Another part of the bolt 75 occupies the space between the third rail 45 and the second rail 40. This particular bar percussion instrument is resting on the bracket using the part of the bolt that is between the third rail and the fourth rail. Another bar percussion instrument may alternatively rest on the bracket using the part of the bolt between the second rail and the third rail.

Figure 6:
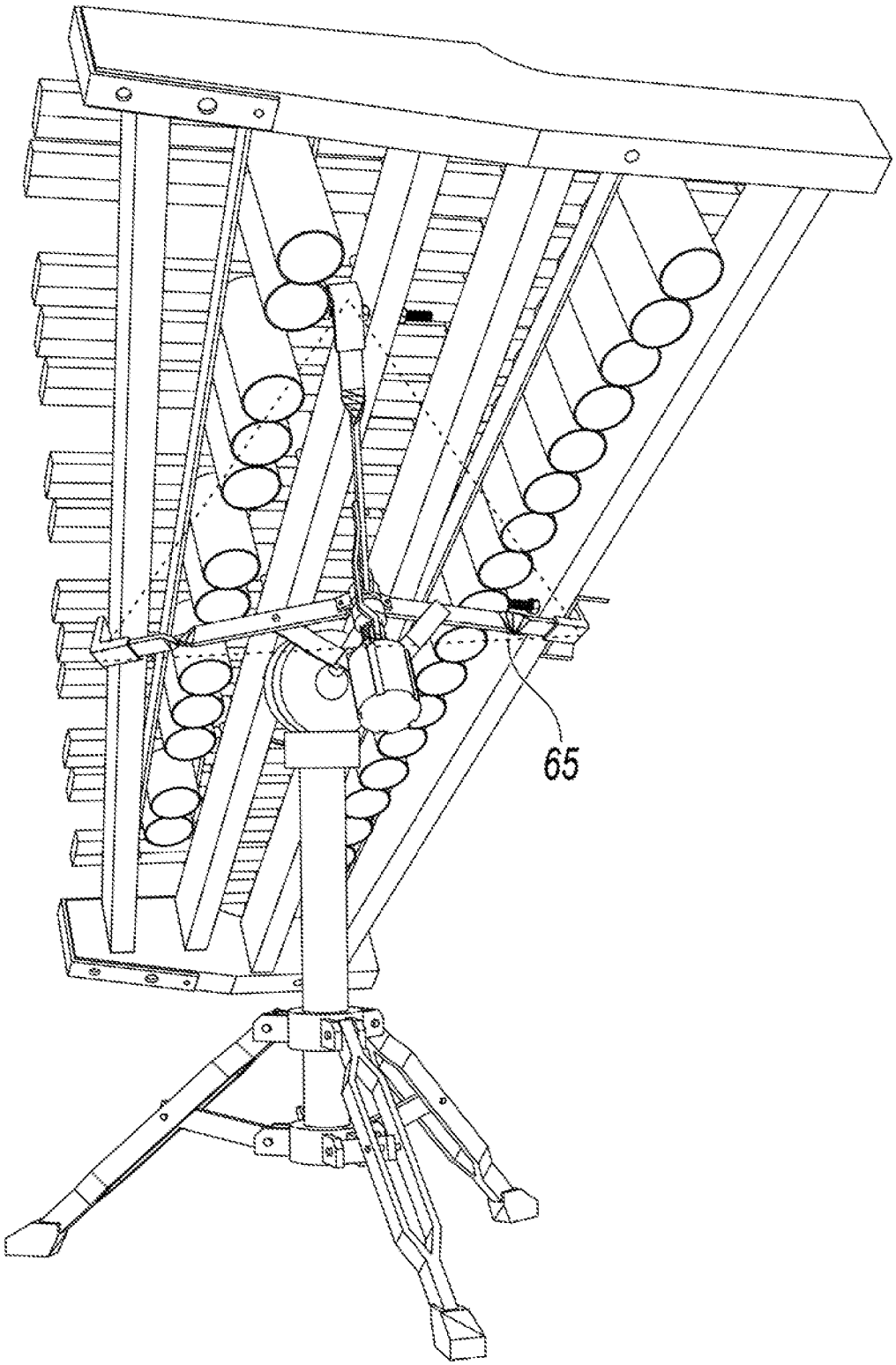
FIG. 6 is a perspective bottom view of the system.
Figure 7:
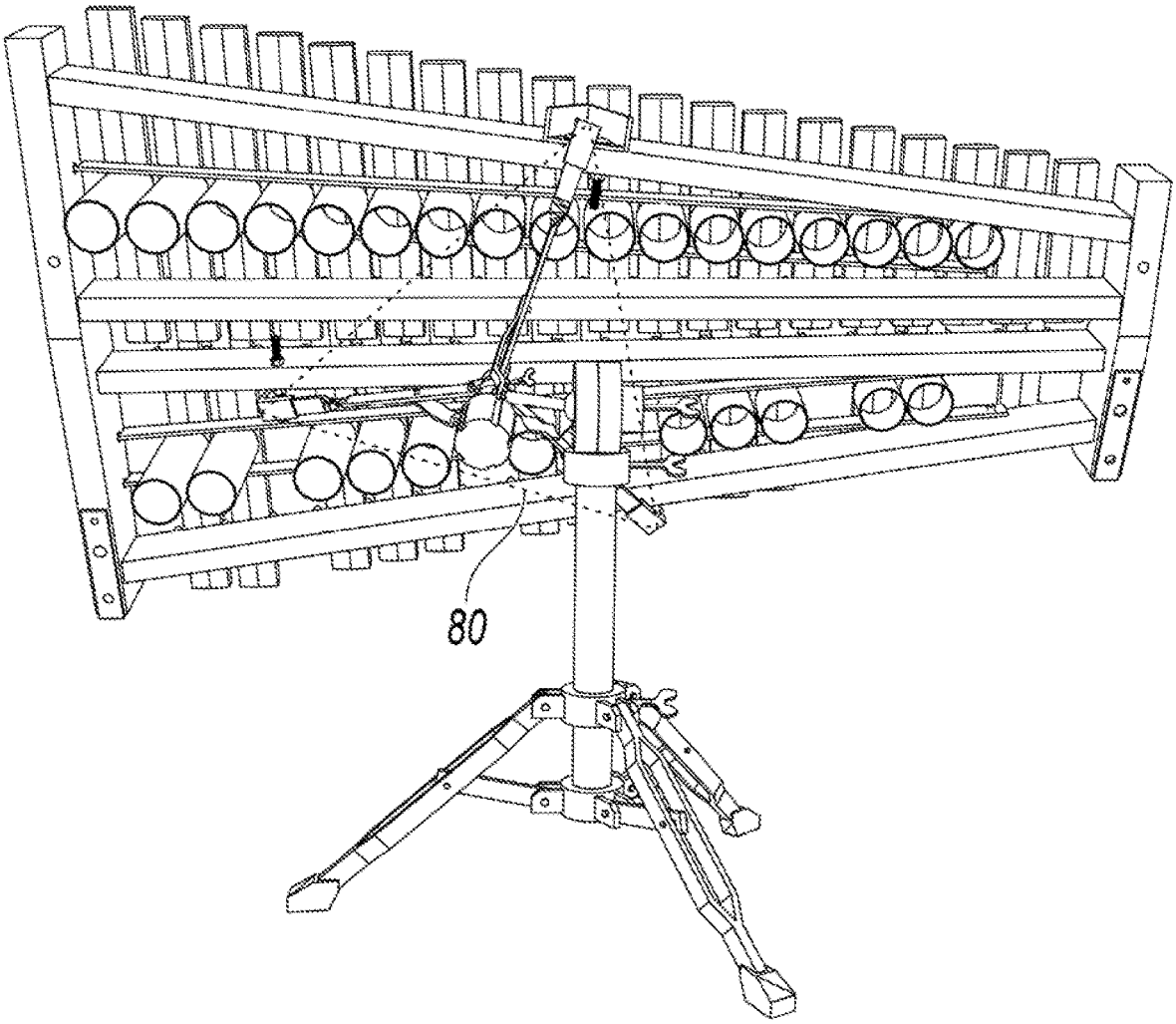
FIG. 7 is an alternative perspective bottom view of the system.
Figure 8:
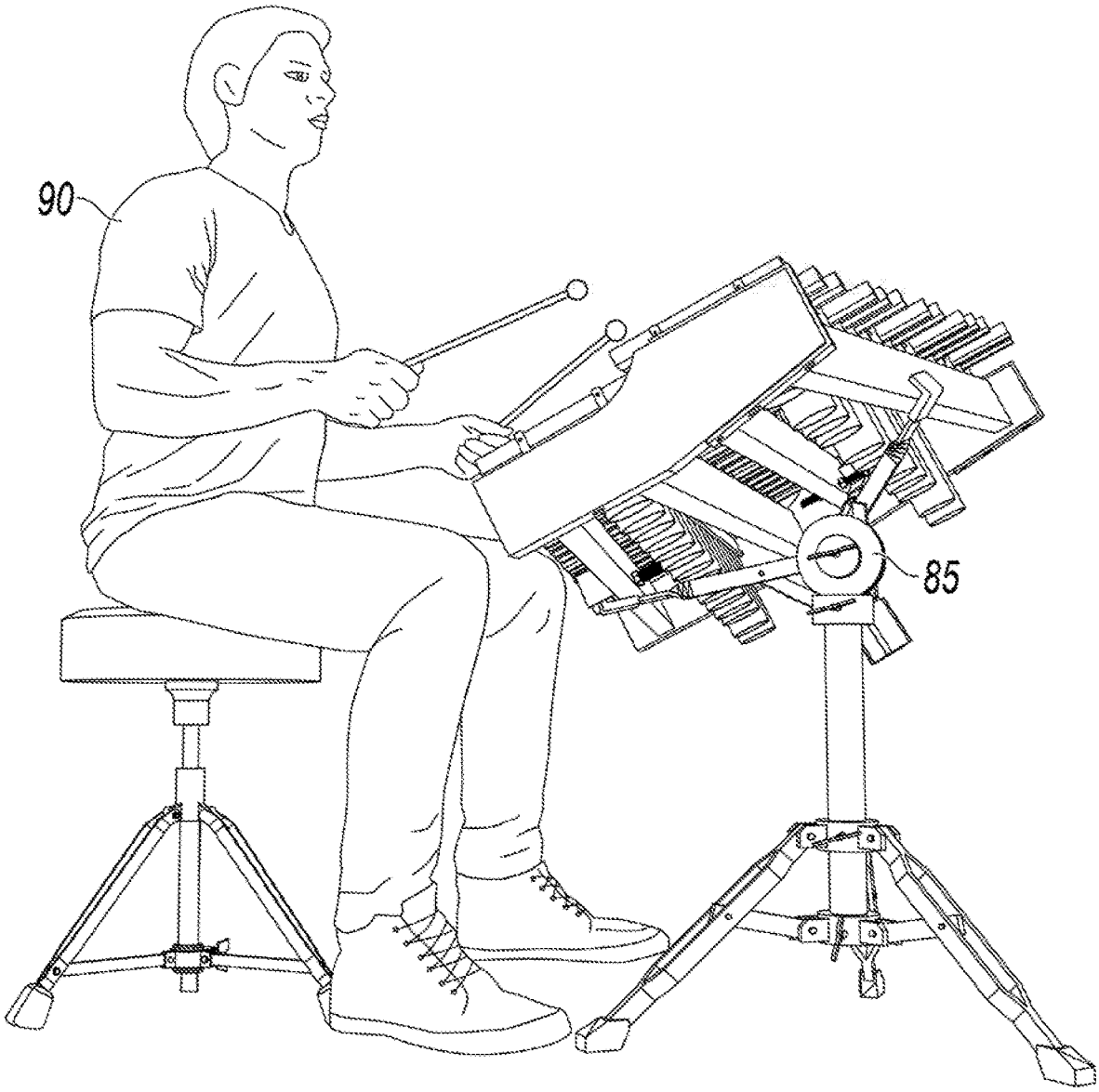
FIG. 8 shows a seated musician playing the system in a tilted position.

FIG. 6 shows the outline of the supporting triangle defined by the three brackets of the snare drum basket. FIG. 7 shows the outline of the corresponding receiving triangle defined by the corner brace, the bolt and the 45.5% point of the bottom of the fourth rail, mounted to the bar percussion instrument. FIG. 8 shows a seated musician 90 having used the ball joint 85 to tilt the bar percussion instrument toward him so he can play while seated.

I claim:

1. A system for supporting a bar percussion instrument in a snare drum basket, comprising:

a. A bar percussion instrument framed by four longitudinal rails and two end pieces, each rail having a top, a bottom and a length, wherein a first rail lies closest to a player, a fourth rail lies closest to an audience, a second rail and a third rail, respectively, lie between the first and the fourth rail, in that order, this frame of longitudinal rails having a trapezoidal footprint, wherein further the first rail has a player-facing side and the fourth rail has an audience-facing side;

b. a snare drum basket having three arms, each arm having a proximal end hinged to a central hub, from whence the arms open and close, and a distal end, the central hub operatively connected to a central post;

c. a bracket joined to the distal end of each of the three arms of the snare drum basket, these three brackets defining a supporting triangle when the arms are open;

d. a corner brace having a flat surface and a pair of flaps extending from and perpendicular to the flat surface and meeting in a corner joint, wherein the flat surface of the corner brace is affixed to the player-facing side of the first rail with its corner joint pointed toward the top of the first rail;

e. a point 45.5% of the length of the fourth rail, located along the bottom of the fourth rail and measured from a left side of the audience-facing side of the fourth rail; and f. a bolt installed perpendicularly through the third rail such that a first portion of the bolt extends into a space between the third rail and the fourth rail, and a second portion of the bolt extends into a space between the second rail and the third rail, wherein either the first or the second portion of the bolt, together with the corner brace and the 45.5% point of the fourth rail, define points of a receiving triangle which rests upon the supporting triangle.

2. The system of claim 1, wherein the bar percussion instrument further comprises a row of resonator tubes hanging between any two adjacent rails.

3. The system of claim 1, wherein the snare drum basket connects to the central post by a ball joint.

4. The system of claim 2, wherein the bar percussion instrument is selected from the group consisting of xylophone, vibraphone, marimba, glockenspiel and bell kit.

5. The system of claim 3, wherein the bar percussion instrument is selected from the group consisting of xylophone, vibraphone, marimba, glockenspiel and bell kit.

6. A bar percussion instrument framed on four longitudinal rails and two end pieces, each rail having a top, a bottom, and a length, wherein a first rail lies closest to a player, a fourth rail lies closest to an audience, a second rail and a third rail, respectively, lie between the first and the fourth rail, in that order, this frame of longitudinal rails having a trapezoidal footprint, wherein further the first rail has a player-facing side and the fourth rail has an audience-facing side, the bar percussion instrument further comprising:

a. a snare drum basket having three arms, each arm having a proximal end hinged to a central hub, from whence the arms open and close, and a distal end, the central hub operatively connected to a central post;

b. a bracket joined to the distal end of each of the three arms of the snare drum basket, these three brackets defining a supporting triangle when the arms are open;

c. a corner brace having a flat surface and a pair of flaps extending from and perpendicular to the flat surface and meeting in a corner joint, wherein the flat surface of the corner brace is affixed to the player-facing side of the first rail with its corner joint pointed toward the top of the first rail;

d. a point 45.5% of the length of the fourth rail, located along the bottom of the fourth rail and measured from a left side of the audience-facing side of the fourth rail; and e. a bolt installed perpendicularly through the third rail such that a first portion of the bolt extends into a space between the third rail and the fourth rail, and a second portion of the bolt extends into a space between the second rail and the third rail, wherein either the first or the second portion of the bolt, together with the corner brace and the 45.5% point along the bottom of the fourth rail, define points of a receiving triangle which rests upon the supporting triangle.

7. The bar percussion instrument of claim 6, further comprising a row of resonator tubes hanging between any two adjacent rails.

8. The bar percussion instrument of claim 7, wherein the bar percussion instrument remains supported in the snare drum basket when the snare drum basket is tilted.

9. The bar percussion instrument of claim 8, wherein the bar percussion instrument remains supported by the snare drum basket when the snare drum basket is tilted.

10. The bar percussion instrument as in claim 9, wherein the bar percussion instrument is selected from the group consisting of xylophone, vibraphone, marimba, glockenspiel and bell kit.

11. A method of tilting a bar percussion instrument, comprising the steps of:

a. Supporting the bar percussion instrument of claim 6 in a snare drum basket having three brackets defining a supporting triangle, a central post and a ball joint connecting the snare drum basket to the central post; and b. Tilting the snare drum basket relative to the central post.

* * * * *